US007735292B2

(12) United States Patent
Massie

(10) Patent No.: US 7,735,292 B2
(45) Date of Patent: Jun. 15, 2010

(54) MASONRY CAVITY WALL CONSTRUCTION AND METHOD OF MAKING SAME

(76) Inventor: Michael C. Massie, 13718 NE. 172nd St., Brush Prairie, WA (US) 98606

( * ) Notice: Subject to any disclaimer, the term of this patent is extended or adjusted under 35 U.S.C. 154(b) by 688 days.

(21) Appl. No.: 11/398,292

(22) Filed: Apr. 5, 2006

(65) Prior Publication Data

US 2006/0242921 A1 Nov. 2, 2006

Related U.S. Application Data

(60) Provisional application No. 60/671,976, filed on Apr. 14, 2005.

(51) Int. Cl.
*E04G 21/00* (2006.01)
*E04B 1/16* (2006.01)

(52) U.S. Cl. ..... 52/742.14; 52/265; 52/379; 52/383; 52/404.2; 52/426; 52/745.09

(58) Field of Classification Search ..... 52/379, 52/383, 265, 268, 267, 426, 442, 565, 562, 52/404.2, 127.3, 127.1, 742.14, 127.2, 741.3, 52/741.09, 741.1, 741.13, 745.1, 745.05, 52/745.09; 264/31, 35

See application file for complete search history.

(56) References Cited

U.S. PATENT DOCUMENTS 1,472,642 A * 10/1923 Evans, Jr. ..... 52/379
2,019,236 A * 10/1935 Richter ..... 52/127.3
2,097,821 A * 11/1937 Mathers ..... 52/100
2,213,355 A * 9/1940 Woodworth ..... 52/302.3
3,277,626 A * 10/1966 Brynjolfsson et al. ..... 52/713
3,772,840 A * 11/1973 Hale ..... 52/302.3
4,660,342 A * 4/1987 Salisbury ..... 52/358
4,852,320 A * 8/1989 Ballantyne ..... 52/302.3
4,998,394 A * 3/1991 Holzapfel et al. ..... 52/426
5,040,344 A * 8/1991 Durand ..... 52/127.2
5,816,008 A * 10/1998 Hohmann ..... 52/565
6,532,710 B2 * 3/2003 Terry ..... 52/561
6,789,365 B1 * 9/2004 Hohmann et al. ..... 52/565

* cited by examiner

*Primary Examiner*—Brian E Glessner
*Assistant Examiner*—Adriana Figueroa
(74) *Attorney, Agent, or Firm*—Chernoff, Vilhauer, McClung & Stenzel, LLP

(57) ABSTRACT

A masonry cavity wall structure includes a cast-in-place reinforced concrete structural wall member erected between and in confronting engagement with the outer side of a first, inner masonry wythe and the inner side of an outwardly spaced-away, upstanding wall of rigid insulation panels supported by wire tie members in embedded engagement in the mortar joints of the inner wythe, the inner wythe and tie-supported insulation panels also being used during construction of the cavity wall to provide the supporting concrete formwork for the poured structural wall member. A second, outer veneer wythe is erected a predetermined spaced distance outwardly from the insulation panels and forms an airspace cavity therebetween, the wire tie members also engaged in the mortar joints of the second, outer wythe whereby to structurally tie the masonry cavity wall together. The placement of the cast-in-place reinforced structural wall immediately adjacent the inner wythe and inwardly of the insulation provides maximum thermal mass qualities of the cavity wall construction.

9 Claims, 5 Drawing Sheets

MASONRY CAVITY WALL CONSTRUCTION AND METHOD OF MAKING SAME

This application claims benefit under 35 U.S.C. 119(e) of the priority filing of U.S. Provisional application Ser. No. 60/671,976 filed 14 Apr. 2005.

BACKGROUND OF THE INVENTION

This invention relates to masonry walls used in the construction of buildings, and more specifically to the masonry cavity wall type of masonry wall construction.

In masonry cavity wall construction a wall is typically constructed having two separate wythes with an intermediate space therebetween. Generally, the inner wythe is formed of concrete blocks and typically forms the structural, load-bearing component of the building wall structure. The outer face side of the inner wythe is provided with an insulation layer, commonly rigid foam panels or insulation board. A second, exterior or rain screen wythe is constructed a spaced distance outwardly of the insulation layer, the exterior wythe typically being a non-load bearing wall made of brick, stone or other masonry material. The open space left between the insulation and the exterior wythe provides a continuous, open cavity or air space within the wall structure which allows for condensation and drainage of moisture from the interior confines of the wall resulting from the wicking of moisture through the masonry material of the exterior, decorative rain screen wall, an aspect which is inherent in the use of masonry materials.

The resulting wall structure has been found to be desirable because it is a structurally sound building wall construction that provides good insulating values and affords an aesthetically desirable appearance that may be selected for both the interior finish of the wall as well as the exterior, rain screen, veneer wall material and finish. However, over time, more stringent building codes and requirements have been applied in the construction of buildings with regard to factors including the rebar reinforcement of the load-bearing inner wythe component of the walls-and insulation requirements, etc. In this regard, and as is well understood by those skilled in the masonry industry, these heightened rebar reinforcing requirements now frequently result in a very labor-intensive, time-consuming process of reinforcing the concrete blocks with rebar arrangements that ever-increasingly occupy the space provided by aligned openings through the blocks in vertically-adjacent courses of individual concrete blocks forming the interior wythe wall. The consequent expenses involved in the increased labor and time are unfortunately compelling the building industry to seek alternative wall constructions, to the detriment of the masonry trade and also at the sacrifice of aesthetic values.

In this regard, the building industry is turning to the use of cast-in-place reinforced concrete walls that are formed through use of complex and specialized, dedicated concrete form units that include insulation panels, which is erected by a form work trade and which, after fluid concrete is poured therein, become a permanent element of the building wall structure. In this manner insulated, reinforced cast-in-place structural walls are provided, after which yet another trade must be engaged to provide decorative, veneer finish walls both on the exterior side of the building wall as well as the interior side.

SUMMARY OF THE INVENTION

In its basic concept this invention provides a masonry cavity wall construction having a first, inner masonry wythe component and a spaced-apart, temporarily supported rigid insulation component and an exterior, second wythe component spaced apart from the rigid insulation component, the inner wythe and the insulation being utilized during construction of the wall as a concrete form for the provision of an intermediate, cast-in-place reinforced concrete structural wall component of the cavity wall, a plurality of specialized lateral wire tie members utilized in the construction of the cast-in-place component being additionally arranged to permanently secure the second, exterior wythe to the other components of the cavity wall structure being constructed.

It is by virtue of the foregoing basic concept that the principal objective of this invention is achieved; namely, the provision of a reinforced, insulated masonry cavity wall structure which overcomes the disadvantages and limitations of masonry cavity wall constructions of the prior art.

Another object and advantage of the present invention is the provision of a cavity wall structure of the class described which provides a masonry cavity wall having high thermal mass qualities of the wall structure by including the cast-in-place concrete structural wall component inwardly of the insulation layer of the wall.

Another object and advantage of the present invention is the provision of a masonry cavity wall structure of the class described which provides a secure and permanent interconnection of the interior wythe, exterior wythe, insulation and intermediate structural wall components of the finished wall construction.

Another object and advantage of the present invention is the provision of a masonry cavity wall construction of the class described which is arranged for on-site construction by a single masonry trade, thereby benefitting the masonry industry.

A still further object and advantage of the present invention is the provision of a masonry cavity wall structure of the class described in which the space provided between the inner wythe and the insulation panels is open during construction for facilitated placement of rebar reinforcement as may be desired or dictated preliminary to the introduction of fluid concrete therein during construction.

A still further object and advantage of the present invention is the provision of a masonry cavity wall which, by utilizing a reinforced, cast-in-place concrete load-bearing structural wall component, avoids the heretofore necessary provision of complex rebar reinforcing of the inner wythe component of the wall normally required when the inner wythe is the load-bearing component of the building wall.

A yet further object and advantage of this invention is the provision of a masonry cavity wall construction which simplifies building wall construction, time and labor.

The foregoing and other objects and advantages of the present invention will appear from the following detailed description, taken in connection with the accompanying drawings of a preferred embodiment.

DESCRIPTION OF THE PREFERRED EMBODIMENT

Figure 1:
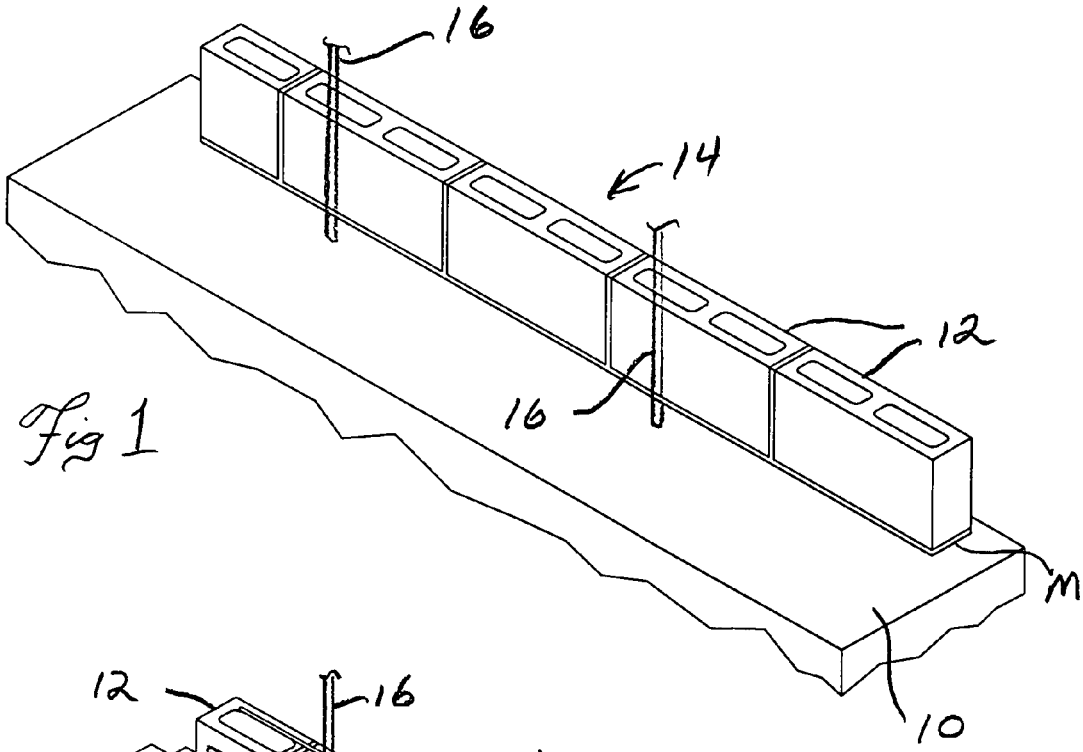
FIG. 1 is a fragmentary perspective view of a beginning stage in the construction of the masonry cavity wall of the present invention.

FIGS. 1-5 illustrate one example of a masonry cavity wall construction embodying features of the present invention in various successive stages during its construction. First, with reference to FIG. 1, a suitable foundation wall footing 10 is provided in typical manner as determined by the construction specifications for the building wall as is well understood in the art.

Then, using mortar M, the mason installs a first course of masonry units illustrated herein as concrete blocks 12 on the foundation footing 10 to the predetermined interior wall building line according to the building specification. This structure will eventually become the first, inner wythe 14 of the masonry cavity wall structure of this invention, the innermost side surface of which will form the interior wall of the building. For reference, the concrete blocks 12 illustrated herein are 4 inches thick, 8 inches tall and have a selected length dimension. Also, the foundation footing 10 may, as illustrated, have been provided during its construction with partially embedded, prepositioned, vertically extending rebar reinforcement 16 positioned at longitudinally spaced-apart intervals outwardly of the predetermined position of the first, inner wythe 14 forming the interior building wall of the building being constructed. The purpose of the vertically extending rebar members 16 will appear later.

Figure 2:
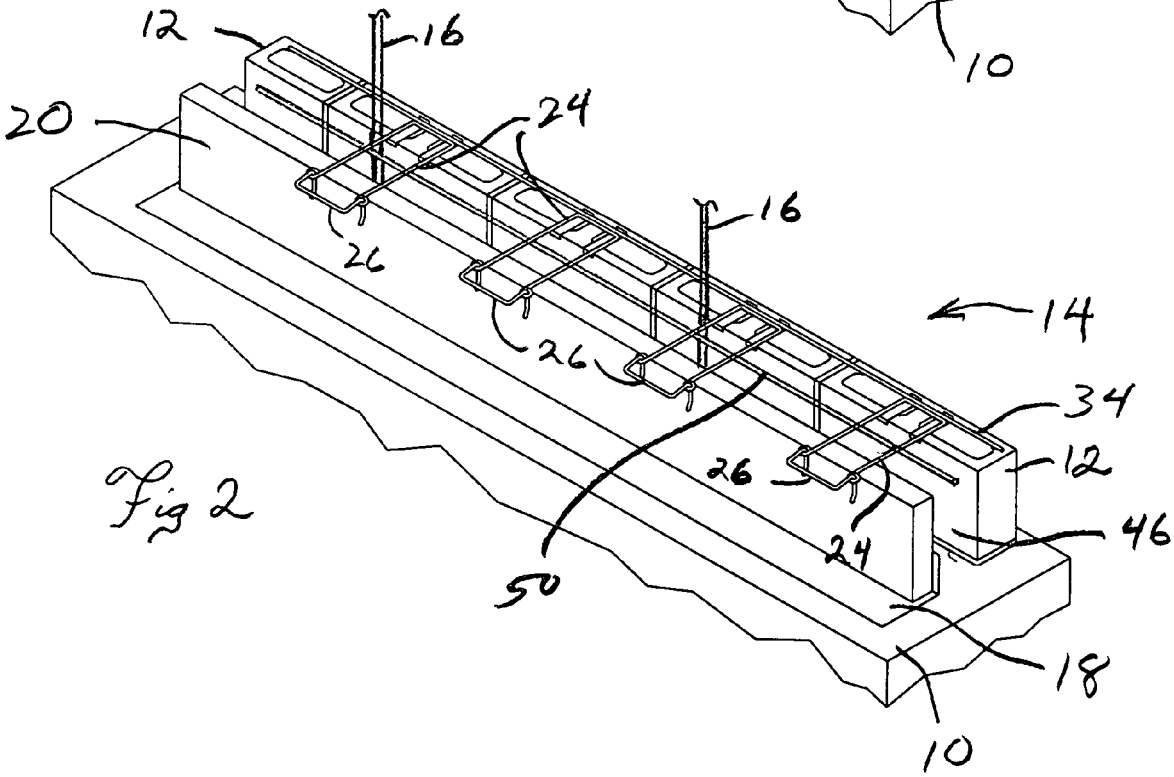
FIG. 2 is a fragmentary perspective view illustrating the wall construction in a second stage of construction.

As seen in FIG. 2 of the drawings, a flexible flashing 18 is then preferably lain on the footing 10 to underly a first, bottom horizontally elongated rigid insulation panel member 20 positioned on edge thereon a predetermined spaced distance outwardly of the installed first course of concrete blocks 12 forming the base of the inner wythe 14. As seen in FIG. 2 the height of this first bottom insulation panel 20 is substantially equal to the height of the concrete blocks 12 forming the first course of the inner wythe of the wall. A plurality of substantially U-shaped, elongated structural tie members 24, which are components of a lateral wire reinforcement tie assembly 22, are then laid across the tops of the first course of concrete blocks and insulation panels in regularly longitudinally spaced-apart positions along the length of the wall as shown.

Turning briefly to this lateral wire reinforcement assembly 22, attention is now directed to FIGS. 6-10 of the drawings wherein it will become clear that the assembly 22 in the present embodiment includes three associated components. The first component is a substantially U-shaped structural tie member 24 shown in FIG. 6. The second component is a temporary-use strongback tie member 26 (FIG. 7), arranged for releasable connection to the structural tie member 24. A third component is an interengaging exterior veneer wythe tie member 28, (FIG. 8), which is arranged for connection to the structural tie member 24 after the temporary-use strongback tie member 26 has been disconnected from the structural tie member.

Figure 6:
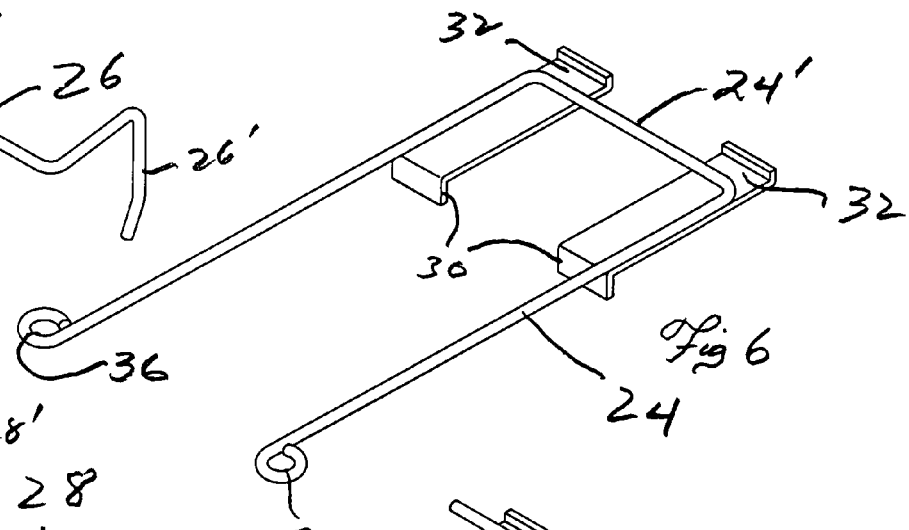
FIG. 6 is a perspective view of a structural tie member of a wire reinforcement tie assembly for the cavity wall construction of this invention.

As seen in viewing FIGS. 2 and 6, the structural tie member 24 is a substantially U-shaped member formed of selected wire reinforcement material and arranged to be placed on the top edge surfaces of the concrete blocks 12 and insulation panels 20, 20', for disposition of the closed end 24' of the member for embedding in the mortar joints between vertically-adjacent courses of block 12 with the terminal ends of the legs at its open end disposed just outwardly of the insulation panels 20, 20' as shown. To assure this proper positioning, the closed end portion 24' may include positioning members 30 such as the block-engaging tab members shown. The closed end may also be arranged with rebar supports 32 arranged to support horizontal rebar reinforcement 34 in position for embedding within the mortar joints between vertically-adjacent courses of the concrete blocks forming the interior wythe 14 as seen in FIG. 2.

Figure 7:
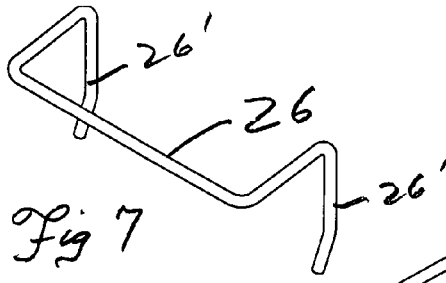
FIG. 7 is a perspective view of a strongback tie member arranged for releasable, temporary connection to the structural tie member during construction of the cavity wall of this invention.
Figure 8:
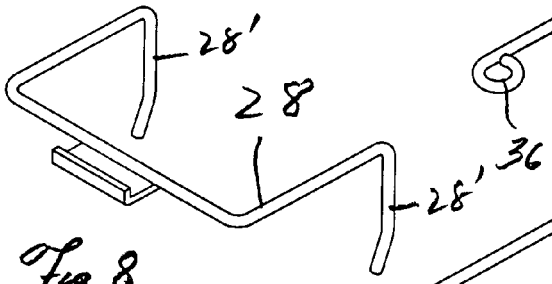
FIG. 8 is a perspective view of an exterior wythe veneer tie member arranged for connection to the structural tie member after the strong back tie member has been removed therefrom.
Figure 9:
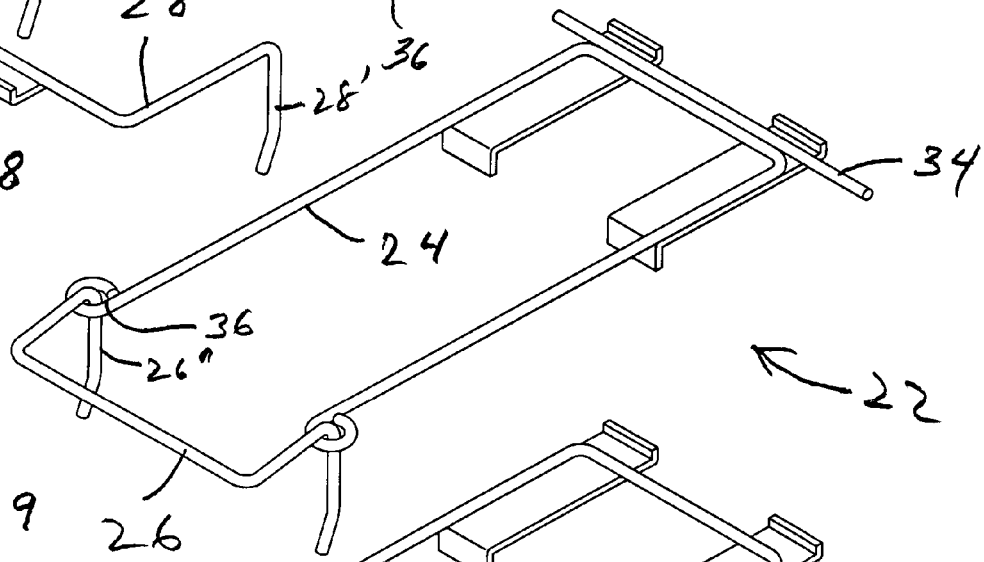
FIG. 9 is a perspective view of the releasable strongback tie of FIG. 7 in engagement with the structural tie member of the wire reinforcement assembly of this invention.
Figure 10:
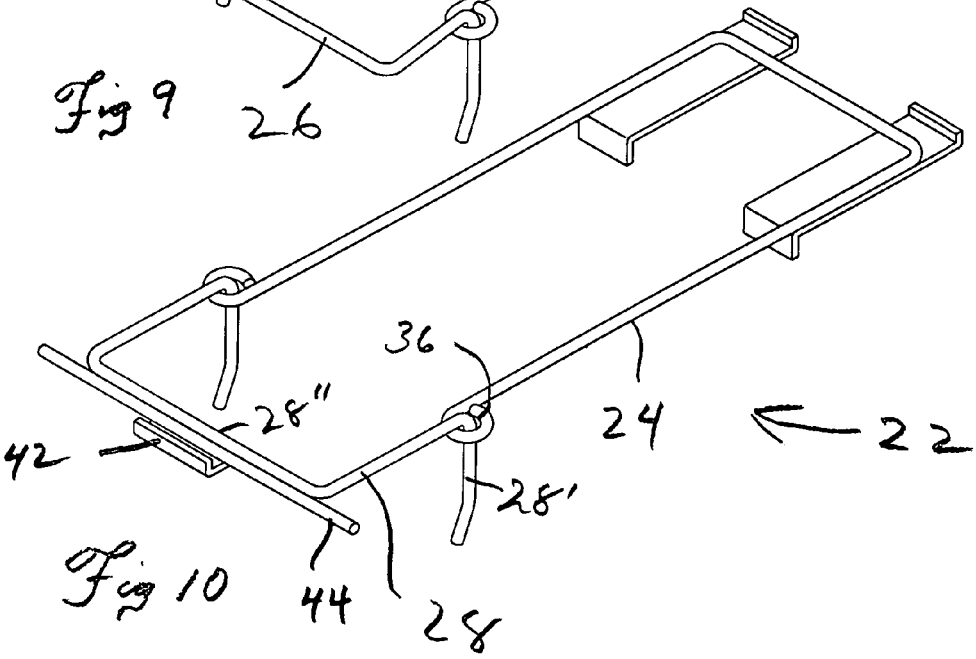
FIG. 10 is a perspective view of the exterior wall veneer tie member in engagement with the structural tie member.

As also seen in FIGS. 6-10, each terminal end of the legs forming the opposite, open end of the U-shaped tie member 24 include a connector coupler member, illustrated herein as closed loops 36, configured for releasable engagement by corresponding connector couplers on the members 26 and 28 whereby to selectively secure a desired one of the members 26, 28 onto the tie member 24. In this regard, FIG. 7 illustrates a strongback tie member 26 formed as an open loop member configured at its open end with terminal leg ends 26' arranged as corresponding connector couplers for engaging the open loops 36 of the member 24 as shown in FIG. 9. The open loop member 26 is arranged to closely encircle and engage a selected strongback member 38 as will become clear later.

Figure 5:
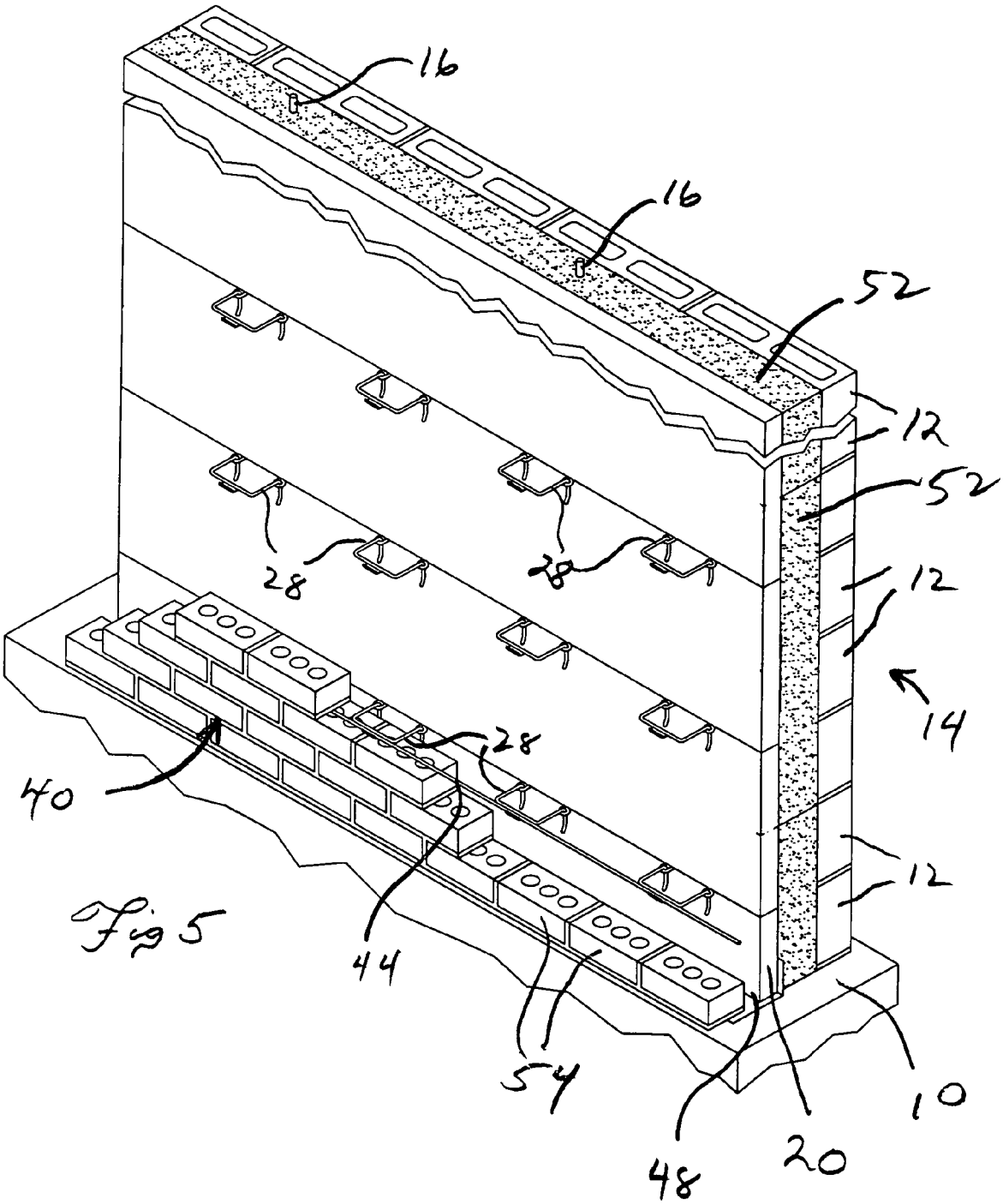
FIG. 5 is a fragmentary, foreshortened view illustrating the wall construction in a stage of construction nearing completion of the masonry cavity wall structure of this invention.

FIG. 8 illustrates an exterior, veneer wall tie member 28 configured as an open ended loop member similar to the strongback tie member 26 but arranged with a predetermined deeper loop for positioning of the closed end 28' of the member on the top surface of selected courses of an exterior wythe 40 of the masonary cavity wall as will also become clear later. As with the rebar support 32 of the structural tie member 24, the veneer tie member 28 may also include a rebar support 42 for engaging and positioning horizontally-extending rebar reinforcement 44 in place for embedding within the mortar joints between selected vertically-adjacent courses of the veneer wythe 40 as seen in FIG. 5.

Returning again to the description of the masonry cavity wall construction in connection with FIG. 2, after the structural tie members 24 have been positioned across the tops of the blocks 12, insulation panels 20 and the intermediate space 46 formed therebetween, a next, vertically adjacent course of concrete blocks 12 is installed, capturing the end portion 24' of the structural tie members 24 in embedded condition within the mortar joint between courses. The mortar joint is then allowed to harden.

After the joint between courses has hardened, it will be appreciated by those skilled in the art that the tie members 24 have become rigidly fixed in place by virtue of their embedded capture in the now hardened mortar joint between courses of concrete block. A second, vertically adjacent course of insulation panels 20' is then installed on top of the bottom course 20, and a strongback tie member 26 is connected to the projecting ends of each structural tie member 24 as is apparent in FIGS. 2 and 3. It should be understood that although the height of the insulation panel members 20' could if desired be the same height as an individual course of concrete blocks 12, as was the case in the initial base wall layer of insulation panel 20, the height of the insulation panels 20' is preferably, as illustrated herein, equal to the height of two courses of the concrete block members, to facilitate wall constructions.

Figure 3:
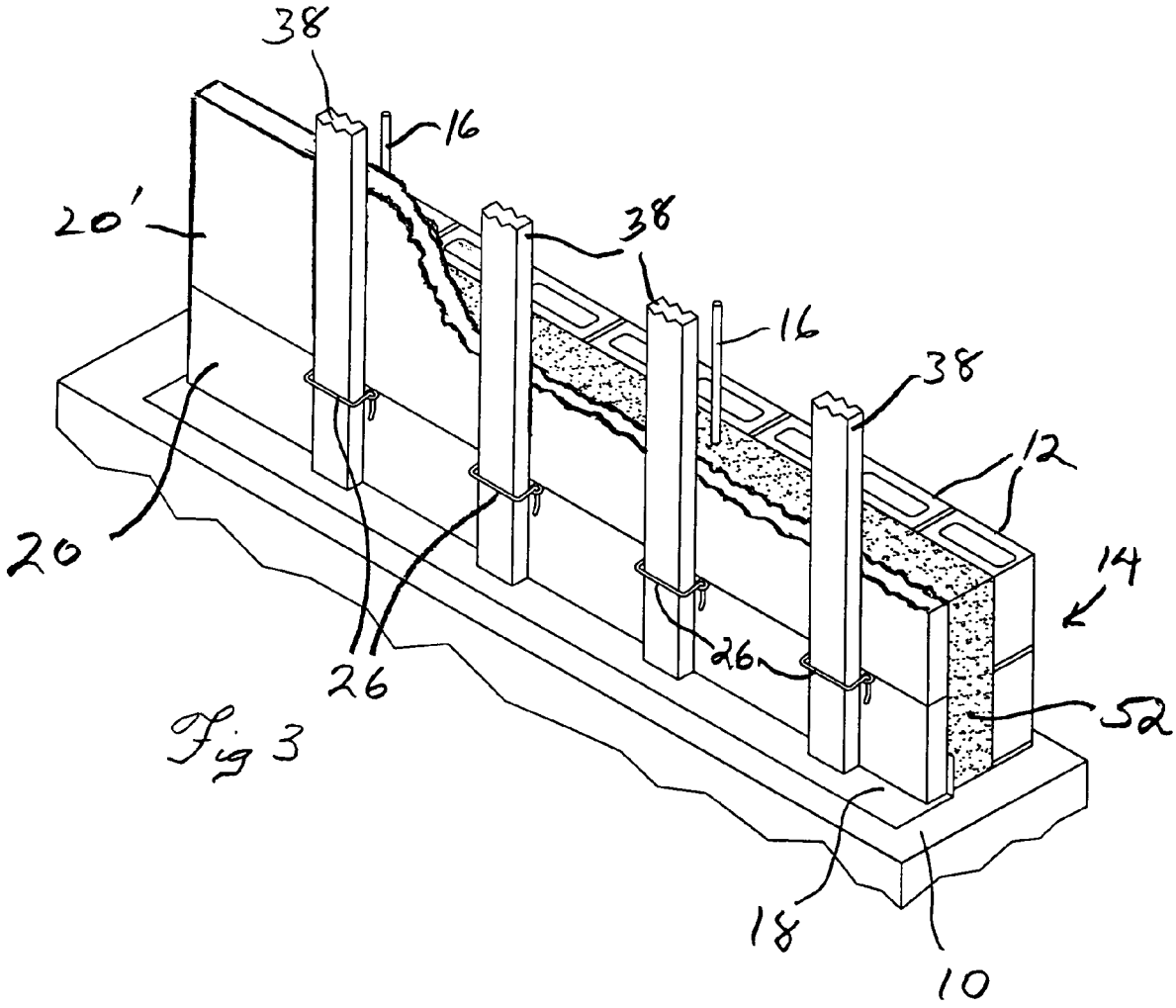
FIG. 3 is a fragmentary perspective view illustrating the wall construction in a third stage during construction, a portion of the second insulation panel being cut away to show detail otherwise hidden
Figure 4:
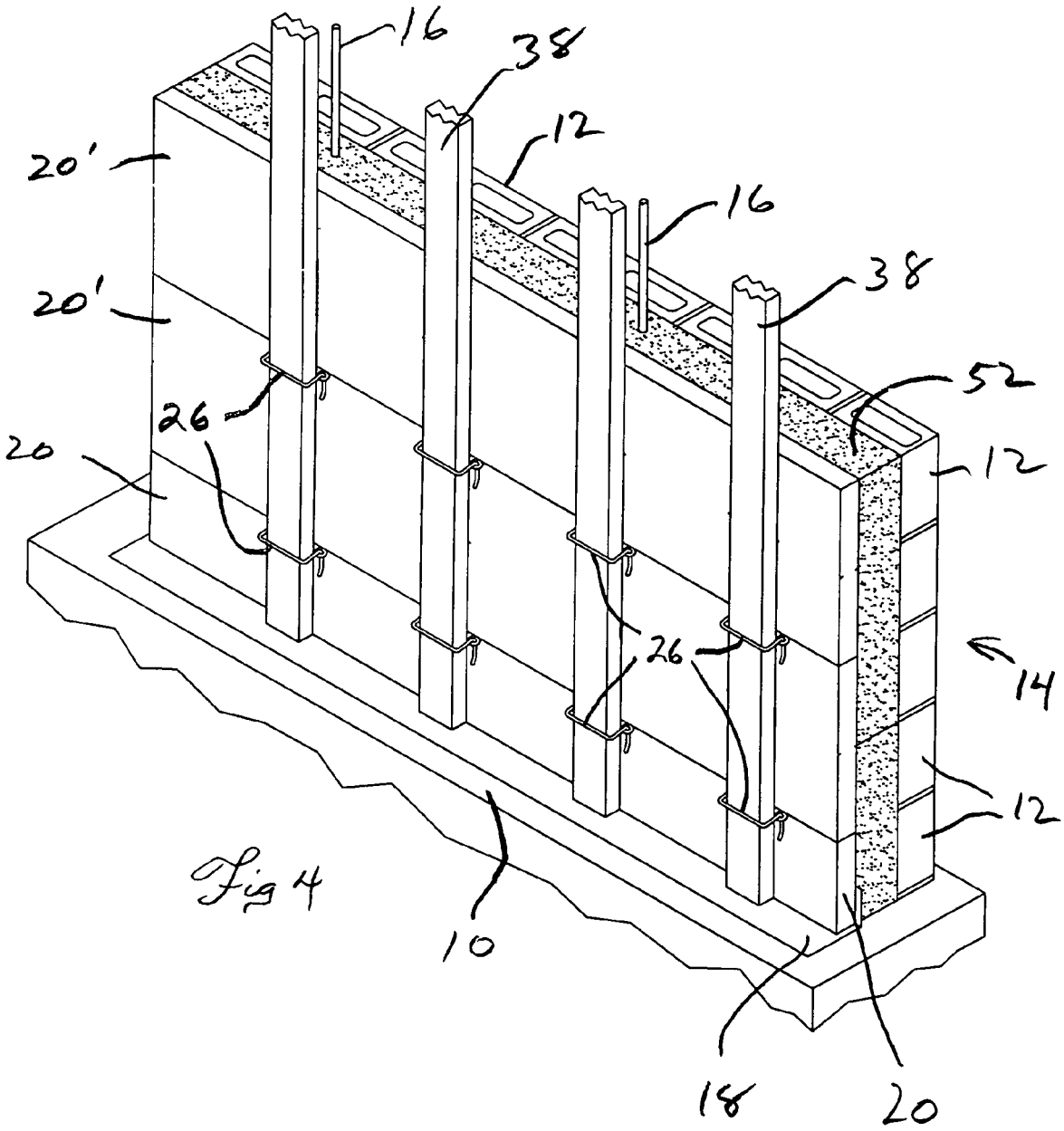
FIG. 4 is a fragmentary perspective view illustrating the wall construction in a fourth stage of construction.

A vertically-extending temporary strongback member 38, illustrated herein as a typical 2×4 wood stud member, is positioned to extend vertically from support of their bottom ends on the footing 10 upwardly through the strongback tie members 26 as shown in FIG. 3. Lengths of wood material (not shown) may be temporarily attached to the footing 10 and positioned to provide an abutting backstop for the bottom ends of the strongback members 38 to prevent them from moving outwardly as will be apparent. Alternatively, the bottommost course of the exterior wythe 40 could be installed on the footing 10 to provide the backstop for the bottom ends of the strong backs 38 if so desired. In either case, the space occupied by the strongback members effectively establishes the air space cavity 48 that will ultimately be formed after the construction of the masonry cavity wall of this invention is complete.

With the strongback members 38 thus securely engaged and held in place by engagement with the temporary tie members 26 connected to the rigidly fixed structural tie members 24, it will readily be apparent that the strongback members provide secure back support for the insulation panels 20, 20'. At this point, horizontal rebar reinforcement 50, if not previously installed, may be laid on and tied to the structural tie members 24 as seen in FIG. 2 and/or otherwise installed in the intermediate space 46 between the outer side surface of the interior wythe 14 and the inner side of the strongback-supported insulation panels 20, 20'. Fluid concrete is then poured into the intermediate space 46 to the top of the second course of concrete blocks 12, as apparent in FIG. 3, and is allowed to harden into the base portion of a cast-in-place reinforced concrete structural wall 52 occupying the confines between the outer side surface of the inner wythe 14 and the inner side surface of the insulation panels 20, 20'.

A next vertically adjacent course of the interior wythe 14 is then installed after which a longitudinally spaced-apart plurality of structural tie members 24 are installed in vertical alignment with the strongback members 38 and structural tie members 24, whereupon the strongbacks are engaged by installation of corresponding strongback tie members 26. Horizontal rebar 50 and other reinforcement may be provided as desired.

A next course of concrete blocks 12 is then installed, capturing the structural tie member ends 24' in embedded condition in the mortar joints as previously described. A next course of insulation panels 20' is then also installed. This construction process is substantially repeated in approximately 4 foot vertical wall construction increments, at which point the intermediate space 46 is filled with fluid concrete, thereby progressively increasing the height of the cast-in-place structural concrete wall component 52 of the masonry cavity wall construction of this invention as the wall is being built.

When the wall structure previously described has been constructed to its predetermined full height, and the cast-in-place concrete and the mortar joints have hardened, the strongback members 38 and strongback tie members are removed and made available for reuse in subsequent wall constructions. The exterior, rain screen wall 40 is then constructed, typically of bricks 54 as seen in FIG. 5. The connectors 28' of the veneer tie members 28 are engaged in the connectors 36 of the structural tie members 24 when the exterior wall height has reached the point at which the veneer tie member can be positioned for embedding within the courses of the exterior wall as previously described and shown in FIG. 5. Of course if desired, all of the veneer tie members 28 could alternatively be installed prior to construction of the veneer wythe, as shown in FIG. 5, should the mason so choose. Those skilled in the art will recognize that, since the structural elements of the masonry cavity wall construction of this invention have been completed prior to the construction of the exterior, veneer rain screen wall, the other structural components of the building being constructed, for example ceiling structure, roof, etc., may begin as soon as these wall components have hardened. In this manner, construction of the exterior wythe of the masonry cavity wall does not interfere with, delay, or impact upon the timing of construction of the rest of the building structure.

From the foregoing it will be apparent to those skilled in the art that the inner wythe 14 is built to finish dimension and serves to provide the inside face concrete form for the provision of a cast-in-place, reinforced structural wall component 52 of the cavity wall construction of this invention. The inner wythe is also utilized, through use of lateral structural tie members 24 and temporary strongback tie members 26 to support temporary strongbacks 38 for the rigid insulation panels while the panels are being used to provide the outer face concrete form for supporting the pressure of the cast-in-place structural wall component while the concrete is in its plastic state. The insulation panels then remain as a permanent, insulation component of the cavity wall construction. Also, the exterior wythe 40 forms a rain screen wall which is separated from the insulation 20, 20' by an air space cavity 48 and is tied to both the inner wythe 14 and the cast-in-place reinforced structural wall 52 by engagement of the exterior wythe 40 with the structural ties 24 embedded within the structural wall 52 and the hardened joints of the inner wythe 14, thereby structurally tying all of the wall elements 14, 52, 20, 20', 40 of the cavity wall permanently together.

It will also be recognized that the positioning of the cast-in-place structural wall component 52 inwardly of the insulation layer 20, 20' of the wall provides for the maximization of the thermal mass qualities of the wall by including the concrete structural wall as an insulated element of the building wall. Also, the cast-in-place concrete structural wall that is formed may contain steel rebar reinforcing arranged to accommodate the forces imposed upon it by the other elements of the building. This allows more latitude in the placement and type of reinforcing members and eliminates the need to accommodate reinforcing rebar through specially shaped masonry block units as is typically required in conventional reinforced unit masonry or insulated concrete forms.

From the foregoing it will also be apparent to those skilled in the art that many various changes, other than those already discussed and described, may be made in the size, shape, type, number and arrangement of parts described hereinbefore without departing from the spirit of this invention and the scope of the appended claims.

Having thus described my invention and the manner in which it may be constructed, I claim:

1. A method of constructing a masonry cavity wall including the steps of:

a) forming a substantially horizontally disposed foundation wall footing, b) forming on the footing a first, inner wythe having a plurality of masonry units secured together by mortar joints, c) during construction of the first wythe, fixedly embedding a first end portion of each of a plurality of lateral tie members in selected mortar joints of the first wythe, wherein each said tie member includes a retainer portion spaced outwardly of said first wythe, d) allowing the mortar joints to harden, e) placing on the footing a predetermined spaced distance outwardly of said first wythe a plurality of rigid insulation panels, wherein the rigid insulation panels are inward of the retainer portions of the lateral tie members, f) engaging a strongback member with the retainer portion of at least one lateral tie member for supportingly engaging the outer side of the rigid insulation panels and thereby providing back support to the insulation panels, g) after step f), pouring concrete into the space between the first, inner wythe and the rigid insulation panels and allowing the concrete to harden into a cast-in-place concrete structural wall, h) after step g), forming on the footing a predetermined spaced distance outwardly from said rigid insulation panels a second, outer, exterior veneer wythe, an airspace cavity being formed by the predetermined space between the second wythe and insulation panels.

2. The method of claim 1 including, during the forming of the inner wythe and placement of the insulation panels and prior to the pouring of fluid concrete in the space formed between the inner wythe and the insulation panels, installing desired rebar reinforcing in the space for embedding of the rebar reinforcing within the cast-in-place concrete structural wall member.

3. The method of claim 1, wherein the retainer portion of each tie member includes a connector coupler member located outward of the outer side of the rigid insulation panels, and step (f) comprises providing a detachable retainer member, releasably engaging the detachable retainer member with the connector coupler member, and engaging the strongback member with the retainer member for providing back support to the insulation panels.

4. The method of claim 3, wherein each tie member is a substantially U-shaped member having a base and two limbs with the base of the U being the first end portion of the tie member and the connector coupler member comprises loops at the free ends of the limbs of the U for receiving the detachable retainer member.

5. The method of claim 4, wherein the detachable retainer member is a substantially U-shaped member having a base and two limbs and the two limbs of the retainer member releasably engage respective loops of the tie member, whereby the base of the retainer member is spaced from the insulation panels, and the strongback member is a stud that is captive between the base of the retainer member and the insulation panels.

6. The method of claim 3, further comprising, between steps f) and g), disengaging the retainer member from the connector coupler member of the tie member and removing the strongback member.

7. The method of claim 1, wherein the retainer portion of each tie member includes a connector coupler member located outward of the outer side of the rigid insulation panels, step (f) comprises providing each tie member with a detachable first retainer member in releasable engagement with the connector coupler member, and engaging the strongback member with the first retainer member for providing back support to the insulation panels, and the method further comprises, after step (f), disengaging the first retainer member from the connector coupler member of the tie member and providing each tie member with a second retainer member in engagement with the connector coupler member, said second retainer member forming said second end portion of the tie member.

8. The method of claim 7, wherein the second wythe formed in step (h) comprises a plurality of masonry units secured together by mortar joints and the method comprises embedding a portion of each second retainer member in a selected mortar joint of the second wythe during its construction.

9. The method of claim 1, comprising attaching a veneer tie member to the retainer portion of each of the lateral tie members and securing an end portion of each of the veneer tie members to said second wythe during its construction.

* * * * *